United States Patent [19]

Ono et al.

[11] 3,971,103

[45] July 27, 1976

[54] SAFETY DEVICE FOR STOPPING THE BALE PLUCKING OPERATION

[75] Inventors: Kazuyoshi Ono, Chiryu; Osamu Suzuki, Kariya; Hideo Hidaka, Aichi, all of Japan

[73] Assignee: Kabushiki Kaisha Toyoda Jidoshokki Seisakusho, Japan

[22] Filed: June 6, 1974

[21] Appl. No.: 476,792

[30] Foreign Application Priority Data

June 13, 1973 Japan ..... 48-69637[U]

[52] U.S. Cl. ..... 19/.2; 19/80 R

[51] Int. Cl.[2] ..... D01G 31/00; D01G 7/00

[58] Field of Search ..... 19/80 R, 81, 105, 97.5, 19/.2, .22, .23; 200/61.09; 241/101 A

[56] References Cited

UNITED STATES PATENTS

| | | | |
|---|---|---|---|
| 511,866 | 1/1894 | Slangerup | 200/61.09 |
| 2,102,906 | 12/1937 | Merchant | 19/.22 |
| 2,938,239 | 5/1960 | Leineweber, Jr. et al. | 19/80 R |
| 3,170,196 | 2/1965 | Denis | 19/80 R |
| 3,208,106 | 9/1965 | Leineweber, Jr. et al. | 19/80 R |
| 3,381,341 | 5/1968 | Platt et al. | 19/80 R |

FOREIGN PATENTS OR APPLICATIONS

| | | | |
|---|---|---|---|
| 485,755 | 11/1929 | Germany | 19/.23 |

*Primary Examiner*—Dorsey Newton

[57] ABSTRACT

A safety device for stopping the bale plucking operation of a bale plucker provided with a detecting device for detecting the existence of metallic substances contained in a fiber bale. The detecting device is disposed at a position along a path of reciprocating movement of the fiber bale back and forth over the working position of a plucking roller of the bale plucker and the driving mechanism of the bale plucker is capable of being instantly stopped by a signal issued from the detecting device upon detection of a metallic substance in the fiber bale so that carrying of the fiber bale to the plucking roller can be prevented.

6 Claims, 5 Drawing Figures

SAFETY DEVICE FOR STOPPING THE BALE PLUCKING OPERATION

SUMMARY OF THE INVENTION

The present invention relates to a safety device for stopping the bale plucking operation of a bale plucker when metallic substances contained in a bale are detected during the operation. The term "bale plucker" means an apparatus for plucking fiber tufts from a fiber bale.

It is well known that a highly compressed block of fiber material is not suitable for processing in the opening and picking process in a spinning factory. Consequently, a bale plucker is conventionally used to pluck fiber tufts from a highly compressed fiber bale before supplying the material fibers to the opening and picking process. However, according to our experience, there is some possibility that a highly compressed fiber bale will contain hard substances such as metallic substances and these hard substances should be removed from the fiber tufts before supplying the tufts to the opening and picking process. In the conventional opening and picking process, a permanent magnet is disposed on a wall of a transportation conduit or hopper, so as to pick up the metallic substances contained in the fibers bales, by the magnetic force thereof, when the fiber tufts containing the metallic substances are carried along the wall of the transportation conduit or hopper. However, in the bale plucking operation, if the above-mentioned metallic substances meet the blades of the plucking roller of the bale plucker, the blades are often broken or the impact of the metallic substances against the blades strikes a spark so that a part of the fiber material is burned. Consequently, even though the above-mentioned magnetic device is utilized, the above-mentioned troubles still remain and should be eliminated.

The principal object of the present invention is to provide a safety device for stopping the bale plucking operation of the bale plucker by detecting the existence of metallic material in the fiber bale before permitting the plucking of the fiber bale by the blades of the plucking roller.

To attain the above-mentioned object, in the present invention the safety device for stopping the operation of the bale plucker comprises means for supplying a fiber bale to a bale plucking device, a driving mechanism for turning the bale plucking device so that it plucks fiber tufts from the fiber bale carried by the supplying means, means for detecting the existence of metallic material such as pieces of iron, aluminum, etc., contained in the fiber bale and, electrical control means for stopping the operation of the supply means and the mechanism for driving the plucking device before the fiber bale is carried to the working position of the plucking device. For the sake of simplifying the following explanation of the present invention, the safety device for stopping the plucking operation of the bale plucker is hereinafter simply referred to as "safety device".

DETAILED EXPLANATION OF THE INVENTION

Figure 1:
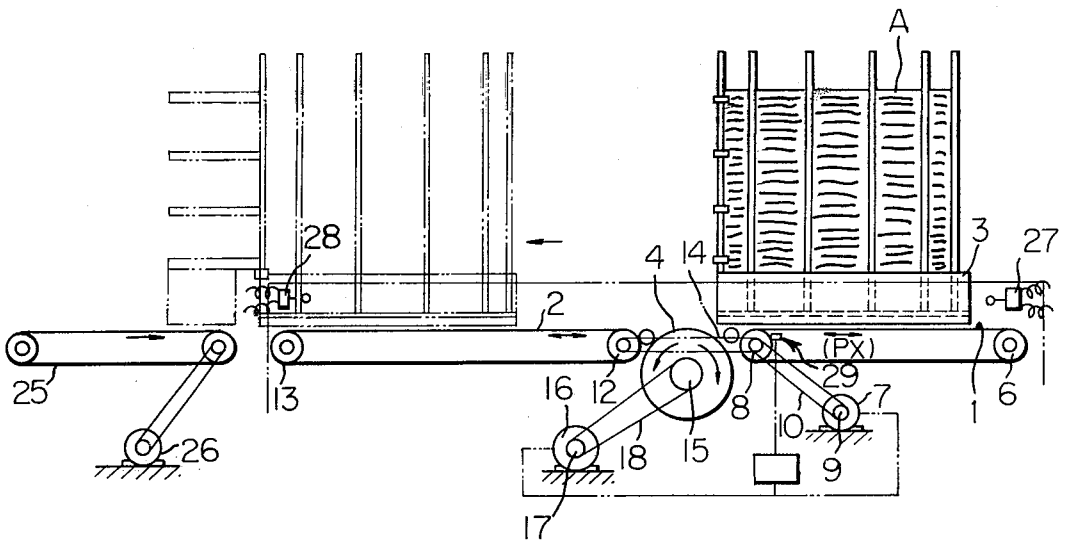
FIG. 1 is a schematic elevational view of a bale plucker equipped with a safety device according to the present invention.

The construction and function of the safety device according to the present invention are hereinafter illustrated in detail with reference to FIGS. 1, 2 and 3. The bale plucker shown in FIGS. 1, 2 and 3 comprises a pair of endless belts 1 and 2 which carry a frame 3 for supporting a fiber bale A toward a plucking roller 4 disposed in an intermediate position between the endless belts 1 and 2. The endless belt 1 is mounted on a pair of cylindrical rollers 5 and 6, and a pulley 8 is rigidly mounted on a shaft of the roller 5 while a pulley 9 is rigidly mounted on a shaft of a motor 7. The pulley 8 is connected to the pulley 9 by way of an endless belt 10 so that the cylindrical roller 5 is driven by the motor 7. At the other end of the shaft of the roller 5, there is provided a pulley 11 rigidly mounted thereon (FIG. 3). The endless belt 2 is mounted on a pair of cylindrical rollers 12 and 13, and the roller 12 is driven by power transmitted from the pulley 11 by an endless belt 14. That is, another pulley (not shown) is rigidly mounted on a shaft of the cylindrical roller 12 and the roller 12 is driven by the pulley 11 by way of the endless belt 14 (FIG. 1). The plucking roller 4 is provided with a pulley 15 rigidly mounted on the shaft of the plucking roller 4 and the pulley 15 is driven by a main motor 16 by way of a pulley 17 secured on the shaft of the motor 16 and an endless belt 18 which connects the pulleys 15 and 17.

Figure 2:
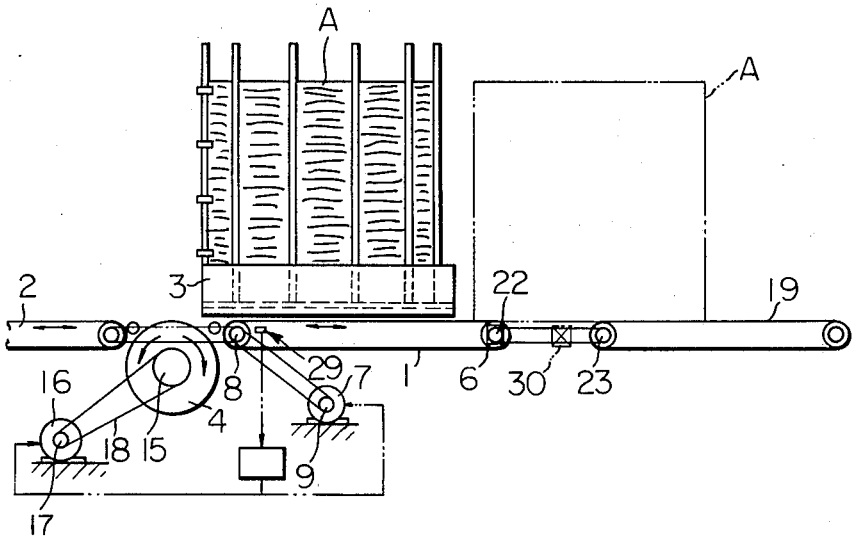
FIG. 2 is a schematic elevational view of a part of the bale plucker shown in FIG. 1.
Figure 3:
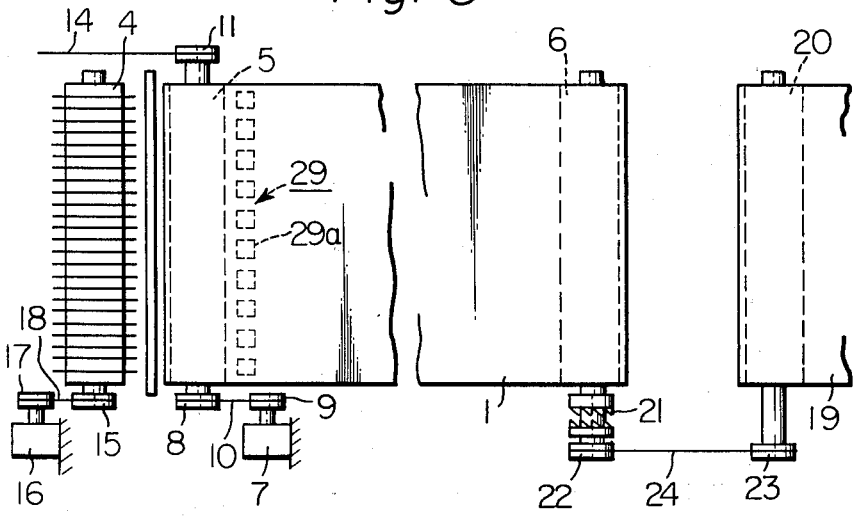
FIG. 3 is a schematic plan view of the bale plucker shown in FIG. 1.

An endless belt 19 for temporarily supporting a fiber bale is disposed in aligned condition to the endless belt conveyers 1 and 2 at a position adjacently outside the endless belt 1 as shown in FIGS. 2 and 3. A driving cylindrical roller 20, which drives the endless belt 19, is driven by the cylindrical roller 6 by way of a power transmission mechanism comprising a clutch 21, a pulley 22, which is capable of being driven by the clutch 21, a pulley 23 rigidly mounted on the shaft of the roller 20 and an endless belt 24 which transmits the driving power of the pulley 22 to the pulley 23. A fiber bale supply conveyer 25 is disposed in aligned condition to the endless conveyer belts 1 and 2 at a position adjacently outside the conveyer belt 2, and this supply conveyer 25 is driven by a motor 26 as shown in FIG. 1.

A pair of limit switches 27 and 28 are disposed to a machine frame (not shown) at terminal end positions of reciprocal carrying passage of the conveyer belts 1 and 2. These limit switches 27, 28 are conventional non-contact type limit switches which detect the arrival of the supporting frame 3 at the respective carrying terminals. These limit switches 27, 28 issue electrical signals which change the rotational direction of the motor 7, by way of a reversible relay (not shown) which connects the motor 7 to an electric source, in counterclockwise or clockwise direction, thus causing the fiber bale to reciprocate back and forth over the plucking roller 4.

Means for detecting the existence of a metallic material in the fiber bale A is disposed in a space between the parallel inside surfaces of the conveyer belt 1 mounted on the cylindrical rollers 5 and 6. The above-mentioned detecting means 29 comprises a plurality of detecting elements 29*a* (FIG. 3) so as to perform the metals-detecting function throughout the entire width of the conveyer belt 1. The conventional resonant type metal sensor or magnetic type metal sensor is preferably utilized for the above-mentioned detecting element 29*a*. These metal sensors operate as follows: that is, in the case of utilizing a resonant type metal sensor provided with a variable frequency oscillator, when a metallic substance such as iron comes into an electromagnetic field which is created by the variable frequency oscillator, the oscillating frequency of the oscillator changes so that the approach of the metallic substance to the sensor can be detected. On the other hand, in the case of a magnetic type metal sensor, when a metallic substance such as iron comes into a gap located in a magnetic path of the sensor, the magnetic reluctance of the magnetic path changes. Therefore, the magnetic reluctance can be used as a means for detecting the presence of the metallic substance coming into the magnetic field of the sensor. The detecting elements 29*a* are positioned in such a manner that they are capable of detecting the existence of the metallic substance contained in the fiber bale A within an effective thickness of 200 mm of fiber bale A as measured from the carrying surface of the conveyer belt 1.

When the detecting means 29 detects a metallic substance in the fiber bale A, the detecting means 29 issues a signal to stop the motors 7 and 16. The operator then puts a provisional mark on the fiber bale A at a position corresponding to the position where the detecting means 29 is actuated. Next, the operator pushes a switch $PB_3$, so as to turn the motor 7 toward a direction for displacing the fiber bale to the conveyer belt 19 while the clutch 21 is also actuated by the switch $PB_3$ so that the fiber bale A is transferred to the supporting belt 19. When the marked portion of the fiber bale A arrives at the free space between the conveyer belt 2 and the supporting belt 19, the operator releases the $PB_3$ switch (refer to FIG. 4) so as to again stop the motor 7. In this condition, the operator utilizes a portable detecting means 30 to find the metallic substance detected by the above-mentioned detecting means 29. The detected metallic substance is extracted from the fiber bale A by manually plucking the fiber bale utilizing a hand plucking device.

When the metallic substance is removed from the fiber bale A, the operator pushes a starting button switch ($PB_2$) (refer to FIG. 4) so as to simultaneously energize an electromagnetic relay MS1 and an electromagnetic relay MS2, which respectively cause the motors 16 and 7 to commence driving in their normal running directions. With the motor 7 being driven in its normal running direction the fiber bale A is transferred to the conveyer belts 1 and 2.

In the above-mentioned embodiment, the detecting direction of the detecting device 29, for the metallic substances contained in the fiber bale A, is upward from the detecting device 29, however, it is capable of detecting the metallic substance contained in the fiber bale A along a horizontal direction from a detecting device which is disposed on the side of the displacing passage of the fiber bale A, instead of the above-mentioned direction of detection.

Figure 4:
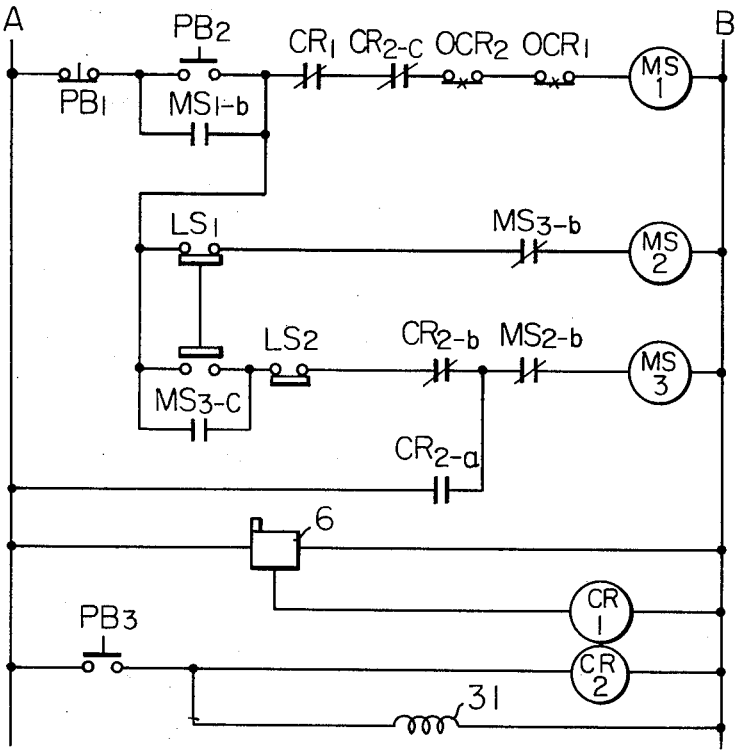
FIGS. 4 and 5 are diagrams of electric circuits for controlling the operation of the bale plucker shown in FIG. 1.
Figure 5:
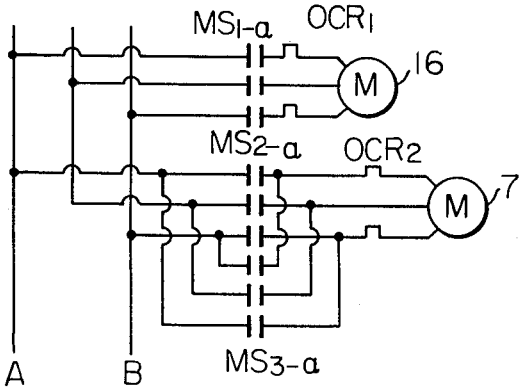

The construction and function of the electric control circuit utilized in the above-mentioned embodiment is hereinafter explained in detail with reference to FIGS. 4 and 5.

When the starting button switch $PB_2$ is operated, the electromagnetic relay MS1 is energized. Then the contactor $MS_{1\text{-}a}$ in FIG. 5 becomes conductive and the electric motor 16 in FIG. 5 starts to rotate in the normal direction. At the same time the relay MS1 is held in an energized condition through the contactor $MS_{1\text{-}b}$ whether the switch $PB_2$ is released or not. In case the limit switch $LS_1$ (corresponding to reference number 28 in FIG. 1) is not operated, that is the switch $LS_1$ is conductive, the electromagnetic relay MS2 is energized. In this case the electric motor 7 in FIG. 5 is energized to rotate in the normal direction through the contactor $MS_{2\text{-}a}$ in FIG. 5, which is now conductive by means of the relay MS2, and the motor 7 moves the bale A in the leftward direction in FIG. 1 by means of conveyer belts 1 and 2.

When the switch $LS_1$ is operated by the bale A, that is the switch $LS_1$ is switched to being non-conductive, the relay MS2 is not energized but the relay MS3 is energized through the contactor $MS_{2\text{-}b}$ which is now conductive by means of the relay MS2. Then the motor 7 is energized to rotate in the reverse direction through the contactor $MS_{3\text{-}a}$ in FIG. 5 and the bale A is moved in the rightward direction in FIG. 1. At the same time the relay MS3 is held in an energized condition through the contactor $MS_{3\text{-}c}$, even though the switch $LS_1$ is released, until the limit switch $LS_2$ becomes non-conductive.

When the switch $LS_2$ (corresponding to reference number 27 in FIG. 1) is operated by the bale A, that is the switch $LS_2$ is switched to being non-conductive, the relay MS3 is not energized but the relay MS2 is energized through $MS_{3\text{-}b}$ which is now conductive by means of said relay MS3. Consequently the motor 7 starts to rotate in the normal direction again, through the contactor $MS_{2\text{-}a}$ which is now conductive and the bale A is moved in the leftward direction in FIG. 1 again.

When the detecting means 29 detects metallic substance, the detecting means 29 energizes the electromagnetic relay CR1 and the contactor $CR_1$ becomes non-conductive, whereby the relay MS1 is not energized. Accordingly, the motor 16 stops rotating because the contactor $MS_{1\text{-}a}$ becomes non-conductive. In addition the motor 7 also stops rotating. This is because the contactor $MS_{1\text{-}b}$ is now non-conductive and, accordingly, the relay MS2 is not energized and, therefore, the contactor $MS_{2\text{-}a}$ is not conductive.

When the push-button switch $PB_3$ is operated, the electromagnetic relay CR2 is energized and the contactor $CR_{2\text{-}a}$ becomes conductive and, accordingly, the relay MS3 is energized.

The motor 7 is then energized to rotate in the reverse direction through the contactor $MS_{3\text{-}a}$. On the other hand, the switch $PB_3$ also energizes the exciting coils 31 and, accordingly, the electromagnetic clutch 21 in FIG. 3 becomes operative. Then the conveyer belt 19 in FIG. 2 is driven together with the conveyer belt 1.

When the switch $PB_2$ is operated (the bale A is now located on the conveyer belt 19), the relay MS1 is energized and the motor 16 is energized, through the contactor $MS_{1\text{-}a}$ to rotate in normal direction again. At the same time, the relay MS2 is also energized through the contactor $MS_{1\text{-}b}$, the switch $LS_1$ and the contactor $MS_{3\text{-}b}$ and, accordingly, the motor 7 is also energized through the contactor $MS_{2\text{-}a}$, to rotate in the normal direction.

The bale A is then moved from the conveyer belt 19 to the conveyer belts 1 and 2, and normal operation is begun again. In FIGS. 4 and 5, OCR1 and OCR2 are conventional over current relays.

As mentioned above, in the safety device according to the present invention, the metallic substances like and iron piece contained in the fiber bale A is detected by the detecting device 29 before the fiber bale A is carried to the working position of the plucking roller 4 and the connections between the electric source and the motors 7 and 16 are instantly cut by the signal issued from the detecting device 29. Consequently, the possible impact of the metallic substance contained in the fiber bale A by the blades of the plucking roller 4 can be previously prevented so that the purpose of the present invention can be satisfactorily attained.

What is claimed is:

1. A bale plucker for plucking fiber tufts from a highly compressed fiber bale by a plucking roller which is constructed to remove fibers with each reciprocating passage of said bale from the bottom of said bale, comprising conveying means for reciprocally shifting said fiber bale in a predetermined path to and from a working position of the plucking roller, driving mechanism for driving said reciprocally shifting device and for driving said plucking roller, an electric circuit which connects said driving mechanism to an electric source, and a safety device for stopping the bale plucking operation of said bale plucker, a device for detecting the existence of metallic substances which are contained in said fiber bale, said detecting device being disposed at a position adjacent said predetermined path of said carrying device and being positioned adjacent to the reciprocal shifting path of said bale to detect the existence of the metallic substance within an effective thickness of said bale from said conveying means, an electromagnetic relay arranged in said electric circuit, said electromagnetic relay being capable of actuation by an electric signal issued from said detecting device, whereby, when a portion of said fiber bale, which contains a metallic substance approaches an effective position of said detecting device according to the plucking operation and therefore said detecting device detects a metallic substance contained in said fiber bale before said bale is carried to said working position of said plucking roller, means connected for actuation of said electromagnetic relay by said signal issued from said detecting means so that said driving mechanism is stopped and displacement of said fiber bale to said working position of said plucking roller is prevented, and supplemental conveyor means adjacent said reciprocating path, to which said bale may be diverted after said driving mechanism is stopped.

2. A safety device associated with a bale plucker according to claim 1, wherein said detecting device comprises a plurality of detecting elements arranged adjacently underneath said carrying passage of said bale transversely.

3. A safety device associated with a bale plucker according to claim 2, wherein each of said detecting elements is a resonant type metal sensor.

4. A safety device associated with a bale plucker according to claim 2, wherein each of said detecting elements is a magnetic type metal sensor.

5. In a bale plucker for plucking highly compressed fiber bale by a plucking roller, provided with a device for reciprocally carrying a fiber bale to a working position of the plucking roller, driving mechanism for driving said carrying device and said plucking roller, an electric circuit which connects said driving mechanism to an electric source, a safety device for stopping the bale plucking operation of said bale plucker, comprising a device for detecting the existence of metallic substances contained in said fiber bale, said detecting device being disposed at a position adjacent to a fiber bale carrying passage of said carrying device, an electromagnetic relay arranged in said electric circuit, said electromagnetic relay being capable of actuating by an electric signal issued from said detecting device, whereby, when said detecting device detects a metallic substance contained in said fiber bale, before carrying said bale to said working position of said plucking roller, said electromagnetic relay is actuated by said signal issued from said detecting means so that said driving mechanism is stopped and displacement of said fiber bale to said working position of said plucking roller is prevented, wherein said carrying device comprises two aligned simultaneously driven endless belts disposed respectively on each side of said working position of said plucking roller, said belts being adapted to carry said bale from one of said belts to the other back and forth over said working position, and wherein limit switches operably associated with said carrying device and connected in said electric circuit are provided for reversing the movement of said belts when said bale is moved to predetermined positions on said belts, and wherein a third endless belt is aligned with and spaced from the end of one of said first-named belts and selectively driven by the drive thereof, and wherein manually actuated means are provided for carrying said bale from said one of said first-named belts toward and at least partially on to said third belt and stopping the movement of said bale with a selected position thereof in register with the space between said third belt and said one of said first-named belts.

6. A safety device associated with a bale plucker according to claim 5, wherein said electric circuit includes switch means manually operable to cause said drive mechanism to move said bale to a position in which said selected portion thereof is in register with said space, and selectively to cause said drive mechanism to reverse the direction of movement of said belts to return said bale to said one of said first-named belts.

* * * * *